United States Patent [19]

Münstedt et al.

[11] Patent Number: 4,587,037

[45] **Date of Patent: * May 6, 1986**

[54] PYRROLE POLYMERS AS ELECTRICAL HEATING ELEMENTS

[75] Inventors: Helmut Münstedt, Wachenheim; Helmut Gebhard, Boehl-Iggelheim; Herbert Naarmann, Wattenheim; Johannes Schlag, Ludwigshafen, all of Fed. Rep. of Germany

[73] Assignee: BASF Aktiengesellschaft, Fed. Rep. of Germany

[ * ] Notice: The portion of the term of this patent subsequent to Aug. 28, 2001 has been disclaimed.

[21] Appl. No.: 607,158

[22] Filed: May 4, 1984

[30] Foreign Application Priority Data

May 4, 1983 [DE] Fed. Rep. of Germany ..... 3316182

[51] Int. Cl.[4] ..... H01B 1/06

[52] U.S. Cl. ..... 252/500; 252/518; 219/553

[58] Field of Search ..... 252/500, 518; 219/541, 219/542, 547, 548, 549, 553; 204/72, 78, 10, 13, 12, 59 R; 526/258

[56] References Cited

U.S. PATENT DOCUMENTS 3,574,072 4/1971 Louvar ..... 204/72

4,468,291 8/1984 Naarmann et al. ..... 204/72

OTHER PUBLICATIONS

Pyrrole, a Stable Metallic Polymer; Kanazawa et al., J. Chem. Soc. 1979, pp. 854–855.

*Primary Examiner*—Josephine L. Barr

*Attorney, Agent, or Firm*—Keil & Weinkauf

[57] ABSTRACT

Moldings from the class of the pyrrole polymers which are complexed with anions are used as electrical heating elements.

10 Claims, No Drawings

PYRROLE POLYMERS AS ELECTRICAL HEATING ELEMENTS

The present invention relates to electrical heating elements which consist of moldings from the class of pyrrole polymers.

Electrically conductive pyrrole polymers are known, for example from U.S. Pat. No. 3,574,072 and the publications by A. F. Diaz et al., J. Chem. Soc. Chem. Comm. 1979, page 635 et seq., and J. Chem. Soc. Chem. Comm. 1979, page 854 et seq. These electrically conductive pyrrole polymers are formed by anodic polymerization of pyrrole in the presence of a conductive salt. The anions of the conductive salt act as a complexing agent and result in the system comprising polypyrrole and complexing agent being conductive. A number of earlier proposals and publications describe the use of electrically conductive pyrrole polymers in electrical engineering, for example as electrical storage systems, for batteries, as switches or for other electrical components.

The electrical heating elements used hitherto have been exclusively metallic conductors in the form of wires, plates, sheets or strips. The dimensions of the metallic conductors are chosen so that, for a given voltage, the current obtained brings the conductor to the desired temperature. However, metallic conductors used as heating elements have the disadvantage that they are sensitive to corrosive liquids or gases. For example, the elements used for heating corrosive liquids or gases have to be insulated from the medium, so that the corrosive components cannot attack the metal.

It is an object of the present invention to provide electrical heating elements which have little or no sensitivity toward corrosive liquids or gases.

We have found that this object is achieved, in accordance with the invention, by electrical heating elements which consist of moldings from the class of the pyrrole polymers which have been complexed with anions.

In a preferred embodiment of the invention, the said moldings are coated with organic plastics which exhibit low permeability to gases.

The electrically conductive pyrrole polymers used according to the invention possess high conductivity, in general from 1 to $10^2$ S/cm.

The pyrrole polymers are obtained by polymerization of compounds from the class comprising the pyrroles. This class includes pyrrole itself as well as substituted pyrroles, such as N-alkylpyrroles, N-arylpyrroles, and pyrroles which are monoalkyl-, dialkyl-, monohalogen- or dihalogen-substituted at the carbon atoms. To prepare the polymers used according to the invention, it is possible to use pyrrole alone or as a mixture with other compounds from the class comprising pyrroles. Preferably, polymers of unsubstituted pyrrole are used. If polymers of substituted pyrroles are employed, preferred polymers are those of 3,4-dialkylpyrroles, in particular where alkyl is of 1 to 4 carbon atoms, as well as those of 3,4-dihalopyrroles, in particular of 3,4-dichloropyrrole.

The polymers can, if desired, also contain, as copolymerized units, certain amounts of other compounds which are copolymerizable with pyrroles.

Examples of suitable compounds which are copolymerizable with pyrroles are cyclopentadiene, azulene and its derivatives, such as benzazulene or kajaazulene, and fulvene, indene and quadratic acid. Heterocyclic compounds, such as imidazole, thiazole, furan or thiophene, and 2-bromothiophene, 2,6-dimethylpyridine and pyrazine are also suitable. The polymers can contain, as copolymerized units, from 1 to 10 parts, per 10 parts of pyrrole, of compounds which are copolymerizable with pyrrole.

The polymers used according to the invention are preferably obtained by electrochemical polymerization of the pyrroles, the monomers being subjected to anodic oxidation using a current density of, for example, from 2 to 20 mA/cm$^2$ and a voltage of, in general, from 10 to 300 volt. The polymerization is advantageously carried out in the presence of auxiliary liquids in which the pyrroles are soluble, and polar organic solvents can be used for this purpose. If water-miscible solvents are used, small amounts of water may also be added. Preferred solvents are alcohols, ethers, such as dioxane or tetrahydrofuran, acetone, acetonitrile, dimethylformamide and N-methylpyrrolidone.

The polymerization is carried out in the presence of a complexing agent. This is a salt containing an anion from, for example, the group comprising $BF_4^-$, $AsF_4^-$, $AsF_6^-$, $SbF_6^-$, $SbCl_6^-$, $PF_6^-$, $ClO_4^-$, $HSO_4^-$ and $SO_4^{2-}$.

These salts contain as cations, for example, lithium, sodium or potassium. The use of compounds from this class is known. The compound is used in general in an amount such that the pyrrole polymer contains from 20 to 40 mole % of the anionic complexing agent.

However, the pyrrole polymers can also be prepared using other conventional processes. For example, pyrrole can be polymerized in aqueous solution with the aid of a strong acid or an inorganic peroxy compound, such as potassium persulfate. The last mentioned process gives pyrrole polymers in tne form of a fine powder. This process also employs salts, so that the pyrrole polymers are complexed with the appropriate anions.

The moldings which can be used as electrical heating elements are obtained by various methods. For example, in the anodic oxidation of the pyrroles, the polymer formed is complexed with anions and has the shape of the anode used. If the anode is sheet-like, a flat layer of the polymer is formed. If a process giving finely powdered pyrrole polymers is used, the fine powder obtained can be converted to moldings under pressure and heat, using a conventional method. The temperatures used are generally from 150° to 300° C., while the pressures are from 50 to 150 bar. Using this conventional process for the preparation of the anionically complexed pyrrole polymers, it is therefore possible to obtain moldings of any shape. For example, films, sheets or three-dimensional structures can be used.

The dimension, the layer thickness and the linear extension of the moldings depend on the intended use, the voltage to be applied to the electrical heating element, the conductivity specified, and the desired heating temperature.

Particularly useful moldings are those which are coated with organic plastics which have a low permeability to gases. Such plastics are, in particular, polymers of vinylidene chloride, in particular copolymers of vinylidene chloride with acrylates. Advantageous layer thicknesses are from 10 to 150 μm. These polymers can be applied in the form of dispersions or solutions onto the pyrrole polymers using a conventional method, and the layers can be obtained by evaporating the dispersant or solvent. However, other polymers may also be used.

As indicated above, the heating elements can be used wherever there is direct contact between corrosive gases or solutions and heating elements, but they can of course also be used where these conditions do not prevail. Regarding the use of the pyrrole polymer moldings, a particular advantage comprises the mechanical properties of these polymers, which, in the form of thin films or sheets, can easily be bent and can therefore be adapted to the article to be heated. A further particular advantage is that the sheet-like heating elements heat up uniformly over the surface so that burnout phenomena do not occur, as observed, for example, in the case of polyethylenes containing carbon black filler, as a result of the pronounced localized heating in the network formed by the carbon black particles.

EXAMPLE 1

A d.c. voltage of 10 V is applied to a polypyrrole film which has been complexed with 25 mole % of benzenesulfonic acid and is 15 cm long, 1 cm wide and 50 μm thick. A temperature of about 100° C., which is virtually constant over the entire film, is measured by means of a thermocouple lying directly on the film. The temperature can be maintained for several weeks in air, without the film becoming appreciably brittle.

EXAMPLE 2

A polypyrrole sample having the composition stated in Example 1 is immersed, U-shaped, in a glass vessel filled with silicone oil. Its dimensions correspond to those stated in Example 1. Current is supplied via the ends of the film which project out of the silicone oil. Depending on the voltage applied, any temperature from room temperature to 150° C. can be obtained.

EXAMPLE 3

Pyrroles copolymerized with 10% by weight, in each case, of anthracene, N-methylpyrrole, furan or thiophene are used as heating films, similarly to the samples described in Example 1. Their function corresponds substantially to that of the product in Example 1.

EXAMPLE 4

Before being used as a heating film, the polypyrrole of Example 1 is coated with a 100 μm thick layer of an insulating enamel. The film which has been electrically insulated in this way is still extremely flexible and exhibits voltage-temperature characteristics similar to those of the uncoated films.

We claim:

1. A heating element which comprises:

a molding of a pyrrole polymer which has been complexed with anions, said molding being shaped to the desired dimensions of the heating element; and means connected to the molding to pass an electrical current through said molding in a heat generating manner.

2. A heating element as described in claim 1, wherein the pyrrole polymer is a homopolymer of pyrrole.

3. A heating element as described in claim 1, wherein the pyrrole polymer is a homopolymer of a 3,4-dialkylpyrrole, said alkyl containing 1 to 4 carbons, or a 3,4-dihalopyrrole.

4. A heating element as described in claim 1, wherein the pyrrole polymer is a copolymer of 10 parts pyrrole and from 1 to 10 parts of a monomer that is copolymerizable with pyrrole.

5. A heating element as described in claim 1, wherein said molding is coated with an organic compound having a low permeability to gases.

6. A heating element as described in claim 5, wherein said organic compound is a vinylidene chloride polymer.

7. A heating element as described in claim 5, wherein said organic compound is a vinylideneacrylate copolymer.

8. A heating element as described in claim 5, wherein said coating is from 10 to 150 μm thick.

9. A heating element as described in claim 1, wherein said molding is a flexible film or sheet.

10. A heating element as described in claim 5, wherein said molding is a flexible film or sheet.

* * * * *